US008387169B2

(12) United States Patent
Shockman

(10) Patent No.: US 8,387,169 B2
(45) Date of Patent: Mar. 5, 2013

(54) BASEBALL PRACTICE HELMET

(76) Inventor: Craig Shockman, Auburn, WA (US)

( * ) Notice: Subject to any disclaimer, the term of this patent is extended or adjusted under 35 U.S.C. 154(b) by 98 days.

(21) Appl. No.: 13/024,351

(22) Filed: Feb. 10, 2011

(65) Prior Publication Data

US 2012/0204332 A1 Aug. 16, 2012

(51) Int. Cl.
*A42B 1/06* (2006.01)

(52) U.S. Cl. ..... 2/410

(58) Field of Classification Search ..... 2/410, 423, 2/424, 425, 9, 202, 203, 205, 206, 209
See application file for complete search history.

(56) References Cited

U.S. PATENT DOCUMENTS

| | | | | | |
|---|---|---|---|---|---|
| 3,628,191 | A | * | 12/1971 | Douglas | 2/421 |
| 4,660,230 | A | * | 4/1987 | Mayling | 2/413 |
| 4,754,501 | A | * | 7/1988 | Yahn | 2/424 |
| 5,123,116 | A | * | 6/1992 | Roth | 2/15 |
| 5,361,420 | A | * | 11/1994 | Dobbs et al. | 2/425 |
| 6,938,272 | B1 | * | 9/2005 | Brown | 2/9 |
| D535,061 | S | | 1/2007 | Evans et al. | |
| 2007/0250990 | A1 | | 11/2007 | Brown et al. | |
| 2007/0250992 | A1 | | 11/2007 | Brown | |

* cited by examiner

*Primary Examiner* — Tejash Patel
(74) *Attorney, Agent, or Firm* — Arnold de Guzman

(57) ABSTRACT

A baseball training helmet having a helmet portion for protecting a player during practice and an integral face portion that extends away from the helmet portion to form a front aperture that provides a restricted field of view for a player wearing the training helmet.

4 Claims, 1 Drawing Sheet

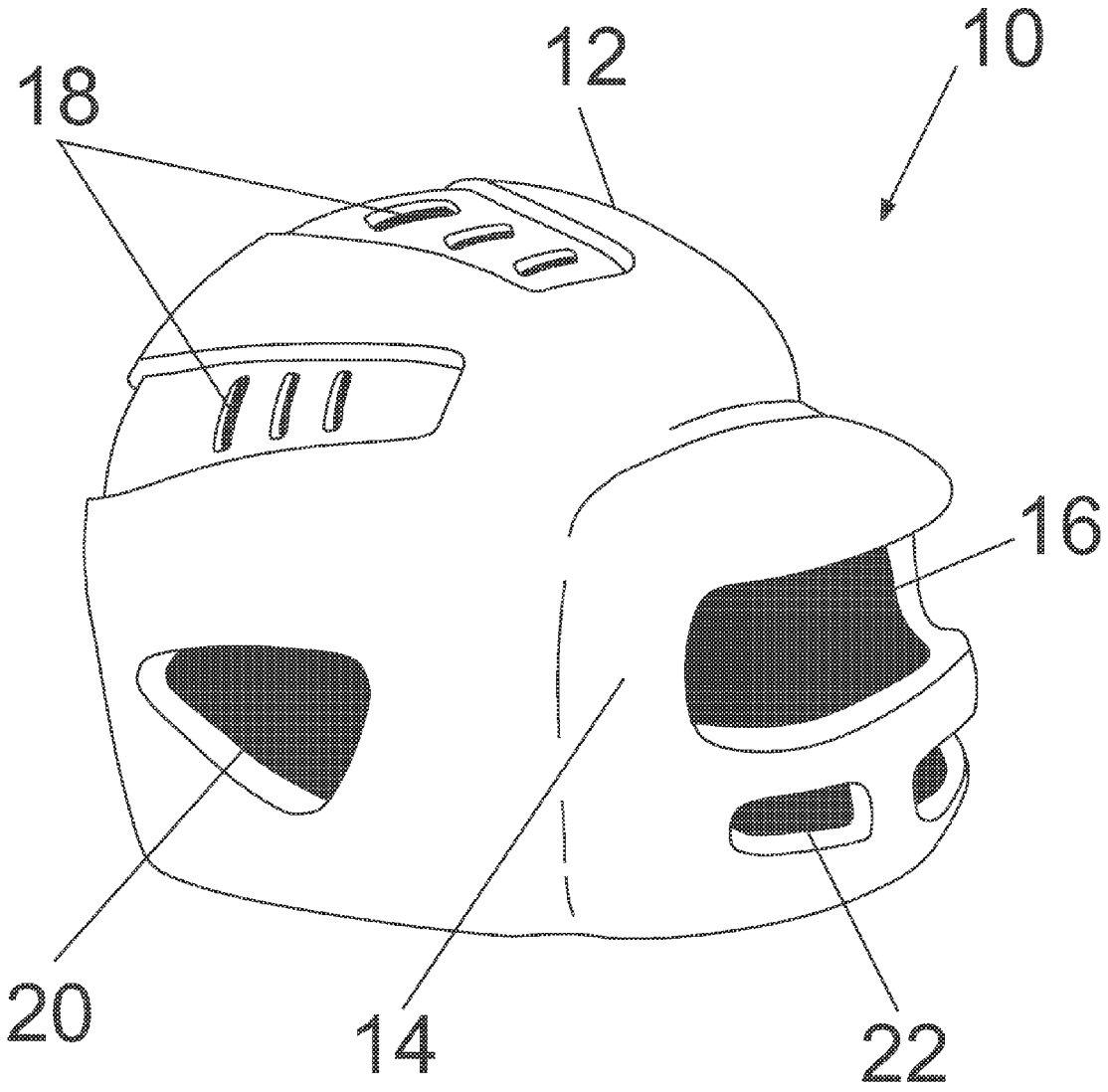
18
12
10
16
20
14
22

BASEBALL PRACTICE HELMET

FIELD OF THE INVENTION

The principles of the present invention are directed towards baseball practice helmets. More particularly, the principles of the present invention are directed to baseball practice helmets that provide head protection while restricting a player's field of view to reduce visual distractions.

BACKGROUND OF THE INVENTION

Baseball is such a well known, widely played sport that in the United States it is referred to as the national pastime. Historically, baseball was played as recreation by soldiers during the American Civil War, and it has been played professionally for well over a hundred years. Furthermore, baseball is played every year by millions of players; while millions more attend games live or watch it on television.

In some communities baseball is played from a very young age until well past middle age. However, baseball is not an easy game to play well. In fact, the ability to hit a major league fastball is considered by some to be the most difficult activity in professional sports. Because of the difficulty of playing baseball well, many locations and communities provide player coaching from an early age until completion of college.

To assist in learning how to play baseball and to actually play baseball, special playing and training devices have been developed. For example, uniforms, hats, special mitts for catchers and first baseman, batting helmets, training helmets, padding, speed guns, and numerous other devices have been developed over the years.

One problem coaches have with teaching proper play is dealing with external visual distractions that a player experiences. For example, friends waving, cars moving, birds flying, and swirling dust, to name but a few, can distract players. Such external distractions present particular problems with younger players who can often be highly, possibly hyper, active and who find it difficult to give the proper focus to learning how to play well. For example, just hitting a baseball is such a difficult thing to do for some younger players that external distractions make it a highly frustrating activity. But, once a player "grooves" his swing so that it becomes a natural reaction to follow a pitched ball along its path, and properly timing his swing, that player is well on his way to becoming a solid hitter.

Unfortunately, in the prior art eliminating outside distractions until a grooved swing develops was very difficult or even impossible to do. Since visual distractions make it difficult for some players to become successful, those players may become frustrated and either stop playing all together or never achieve the success that they are capable of.

Therefore, a technique of reducing visual distractions on a player would be beneficial. Even more beneficial would be a low cost technique that reduces visual distractions on a player.

BRIEF SUMMARY OF THE INVENTION

The principles of the present invention provide for a baseball training helmet designed to reduce the impact of visual distractions on a player. A baseball training helmet according to the principles of the present invention comprises a helmet portion and an integral face portion that extends away from the helmet portion to form a front aperture that provides a restricted field of view for a player wearing the training helmet.

BRIEF DESCRIPTION OF THE DRAWINGS

The advantages and features of the present invention will become better understood with reference to the following detailed description and claims when taken in conjunction with the accompanying drawing, in which like elements are identified with like symbols, and in which:

FIG. 1 is a perspective view of a batting practice helmet 10, according to a preferred embodiment of the present invention.

DETAILED DESCRIPTION OF THE INVENTION

The presently disclosed subject matter now will be described more fully hereinafter with reference to FIG. 1, which shows an embodiment of the present invention. However, it should be understood that this invention may take different forms and thus should not be construed as being limited to the embodiment set forth herein. As used herein, the terms "a" and "an" do not denote a limitation of quantity, but rather denote the presence of at least one of the referenced items.

The principles of the present invention are illustrated herein with reference to FIG. 1, the sole FIGURE. Specifically, the principles of the present invention are incorporated in baseball training helmet 10 that is designed to restrict a player's vision to, and hopefully improve attention and concentration within, a narrow field of view.

A normal, healthy person's field of vision is about 160-170 degrees horizontally. By restricted field of vision it is meant by significantly reducing that field of vision. For example, to a field of vision of 80 degrees of so. The actual field of vision reduction is not as important as reducing that field enough such that visual distractions are significantly reduced.

FIG. 1 shows a perspective view of the training helmet 10. The training helmet 10 has two main sections, a helmet portion 12 and an integral face portion 14 that extends away from the helmet portion 12 to form a front aperture 16.

The helmet portion 12 is a protective, sold piece that includes air vents 18 and ear holes 20. The air vents 18 reduce heat buildup inside the training helmet 10, while the ear holes 20 allow a player to hear directions from a coach or other person.

The integral face portion 14 extends from the helmet portion 12 to form the front aperture 16. The front aperture provides a restricted (narrow) field of view for a person wearing the training helmet 10. The integral face portion 14 and its front aperture 16 are intended to eliminate visual distractions outside of the restricted field of view by providing a "tunnel view port" which helps the player focus on a desired activity. For example, tracking a pitched ball from a pitcher to the player's bat.

It is envisioned that the training helmet 10 will be manufactured by processes and use of materials similar to those used in the production of state-of-the-art baseball helmets.

The principles of the present invention can be utilized by a common user in a simple and effortless manner with little or no training. After initial purchase or acquisition of the training helmet 10, it would be worn by a player during baseball practice. The training helmet would fit such that the player wearing the training helmet 10 would look through the front aperture 16 at an area that he is to concentrate on. For example, a pitcher throwing a ball. The limited viewing range provided by the training helmet reduces distractions and thus leads the player to focus his attention on the path of a ball thrown by a pitcher toward his bat.

Therefore, it is to be understood that while the figures and the above description illustrate the present invention, they are exemplary only. They are not intended to be exhaustive or to limit the invention to the precise forms disclosed, and obviously many modifications and variations are possible in light of the above teaching. Others who are skilled in the applicable arts will recognize numerous modifications and adaptations of the illustrated embodiments that remain within the principles of the present invention. Therefore, the present invention is to be limited only by the appended claims.

What is claimed:

1. A baseball training helmet, comprising:

a protective helmet portion for fitting over a head of a baseball player; and a face portion that extends away from the helmet portion to form a front aperture;

wherein the baseball training helmet comprises a baseball batting practice helmet that is worn by the baseball player during a baseball batting practice;

wherein the helmet portion and the face portion are integrally connected;

wherein the face portion forms a front aperture;

wherein face portion and the front aperture are configured to reduce a field of vision of the baseball player wearing the baseball batting practice helmet by not less than 80 degrees horizontally and at less than 160 degrees horizontally;

wherein the front aperture provides a tunnel view port for tracking a path of a pitched baseball from a pitcher to a bat held by the baseball player.

2. The baseball training helmet according to claim 1, wherein the helmet portion includes vent holes for reducing heat buildup inside the baseball training helmet.

3. The baseball training helmet according to claim 1, wherein the helmet portion includes ear holes.

4. The baseball training helmet according to claim 1, wherein the face portion and the front aperture provide a restricted field of vision for the player wearing the helmet.

* * * * *